United States Patent [19]

Post

[11] Patent Number: 4,509,032

[45] Date of Patent: Apr. 2, 1985

[54] MAINS TRANSFORMER

[75] Inventor: Sieghard Post, Guntersdorf, Fed. Rep. of Germany

[73] Assignee: U.S. Philips Corporation, New York, N.Y.

[21] Appl. No.: 470,653

[22] Filed: Feb. 28, 1983

[30] Foreign Application Priority Data

Mar. 3, 1982 [DE] Fed. Rep. of Germany ..... 3207606

[51] Int. Cl.[3] ..... H01F 15/04; H01F 27/08

[52] U.S. Cl. ..... 336/59; 336/60; 336/83; 336/84 M; 336/98

[58] Field of Search ..... 336/59, 60, 84 R, 84 C, 336/84 M, 90, 92, 98, 136, 83

[56] References Cited

U.S. PATENT DOCUMENTS

| | | | |
|---|---|---|---|
| 1,740,458 | 12/1929 | Hebrew | 336/84 C X |
| 2,340,729 | 2/1944 | Zelt | 336/59 |
| 2,823,362 | 2/1958 | Geroulo et al. | 336/84 X |
| 2,882,505 | 4/1959 | Feder | 336/92 X |
| 3,162,829 | 12/1964 | Wildy et al. | 336/136 X |
| 3,599,134 | 8/1971 | Galloway | 336/92 X |
| 3,617,966 | 11/1971 | Trench et al. | 336/92 X |
| 3,708,774 | 1/1973 | Menju et al. | 336/92 X |

*Primary Examiner*—Thomas J. Kozma

*Attorney, Agent, or Firm*—Robert T. Mayer; Bernard Franzblau

[57] ABSTRACT

A transformer (3) having a ferromagnetic core (5, 7) provided with windings and a metal screening device which comprises a screening sheath surrounding the core (5, 7). The screening device comprises supporting caps (25, 27) which are placed on the transformer from opposite directions and between which the screening sheath (13) is clamped at a distance from the core. The screening device may also serve as a holder for the transformer on a chassis of an apparatus.

12 Claims, 7 Drawing Figures

MAINS TRANSFORMER

This invention relates to a supply transformer having a ferromagnetic core provided with windings and a screening sheath surrounding the core.

A magnetic screening for a transformer having a core of laminated strip iron is known from U.S. Pat. No. 4,460,884, in which the screening consists of a strip turn which is laid around the core and is fixed on the core. The screening turn is kept taut and spaced from the core by means of expansion wedges extending transversely to the direction of the screening turn. Such a turn with inserted expansion wedges which keep the strip turn taut is labour-intensive and vulnerable.

In AC line transformers for electrical apparatus which are sensitive to interference radiation, it is in addition always necessary to provide special holders with which said line transformers are connected to the chassis of the apparatus. Such holders are usually provided on the chassis by the manufacturer of the apparatus, while the transformers themselves are supplied without special holders by the manufacturer of the transformer.

It is an object of the invention to provide a transformer having a screening device which can be assembled easily and without any problems and which, if desired, can also be used as a holder on the chassis of the apparatus.

For that purpose the transformer according to the invention is characterized by supporting caps which are placed on the transformer from opposite directions and between which the screening sheath is clamped at a distance from the core.

The required screening is provided by means of the screening sheath which is held at a sufficient distance around the core. The screening device can be provided around the transformer in a simple manner, which can even be done fully automatically.

A further embodiment of the invention is characterized in that the edges of the screening sheath are fixed in grooves of the supporting caps, the grooves preferably comprising lugs which extend transversely to the longitudinal direction of the grooves and into which the edges of the screening sheath penetrate. In themselves the edges of the screening sheath are fixed rigidly already in the grooves of the supporting caps. It is possible, however, that in unfavourable cases a buzz still arises. Said buzz is avoided when the edges of the screening sheath penetrate into the lugs and are fixed therewith in the grooves without the buss occurring. The lugs are deformed upon screwing. They compensate for the existing difference in height of the lamination pack of the transformer and the differences in dimensions of the other components and ensure on all sides the necessary press-on force between the assembled components.

For assembling the screening components it is advantageous for the lugs to open towards the open side of the grooves in the form of a V.

An important problem in AC line transformers is that they become warm during operation. Consequently there must be sufficient free space around the transformer or the transformer must be ventilated so that the surrounding components cannot be damaged by the thermal energy. A preferred embodiment of the transformer in accordance with the invention is therefore characterized in that the supporting caps are provided with ventilation apertures above and below the space between the core and the screening sheath. In this manner a chimney effect is obtained between the core and the screening sheath by means of which the heat due to energy losses is dissipated. The sensitive surrounding components consequently need not be provided at an extra distance from the line transformer or its screening device.

The supporting caps may be used not only for holding the screening sheath. According to a further embodiment of the invention the supporting caps are designed as an assembly holder for the transformer. For that purpose it is necessary only for the supporting caps to comprise suitable apertures and flanges which enable a direct assembly on a chassis of an apparatus.

A so-called switching-on click in the form of switching-on noise often occurs in transformers. The switching-on click according to a further embodiment of the invention is avoided by means of the screening device in that continuous ducts extend between the clamped edges of the screening sheath.

The interference radiation of the transformer is screened particularly readily when, according to a further embodiment of the invention, the spacing between the core and the screening is approximately 5 to 10 mm.

The invention will now be described in greater detail with reference to the embodiments shown in the drawing. In the drawing.

A mains transformer 3 of any usual construction has an iron core which is composed of laminated I-core parts 5 and laminated E-core parts 7. The core parts 5 and 7 are interconnected by means of a welding seam 9. Windings 11 are provided around the non-visible limb of the transformer 3.

Figure 1:
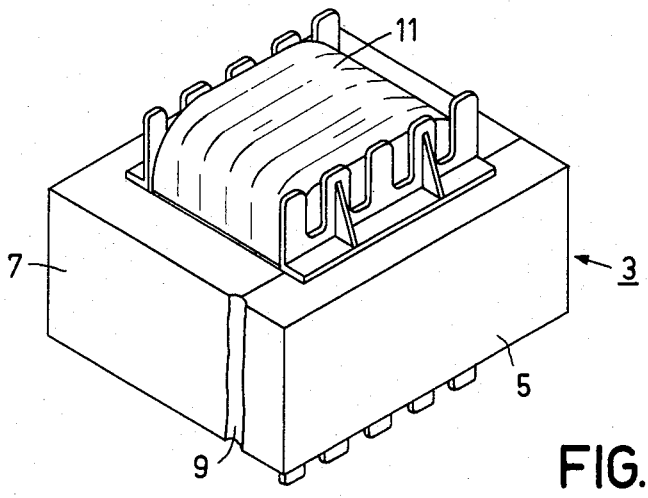
FIG. 1 shows an AC line transformer having a laminated iron I-E core and a winding.
Figure 2A:
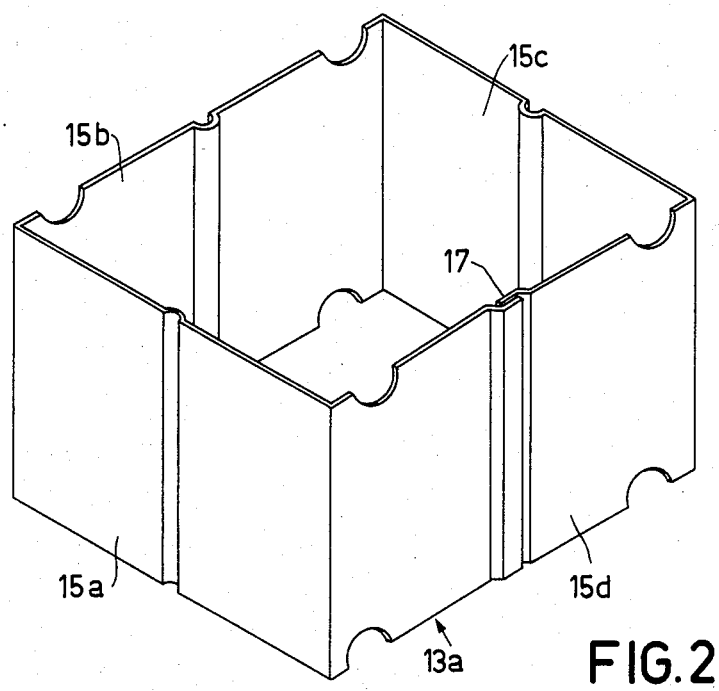
FIGS. 2*a* and 2*b* show two different embodiments of a screening sheath which can be provided around the core.

This transformer, of any conventional construction, is to be provided with an interference radiation screening member. Said interference radiation screening member comprises a screening sheath 13*a* as is shown in FIG. 2*a*. The screening sheath is folded from a strip of sheet metal in such manner that four surfaces 15*a*–15*d* adjoining each other at right angles are obtained. The dimensions of these surfaces are chosen so that the screening sheath upon providing it over the transformer circumferentially, has totally a uniform distance to the core, for example, between 5 and 10 mm. In the embodiment shown in FIG. 2*a* the ends of the folded sheet metal strip overlap each other at the area of the surface 15*d* so that a seam 17 is formed.

Figure 2B:
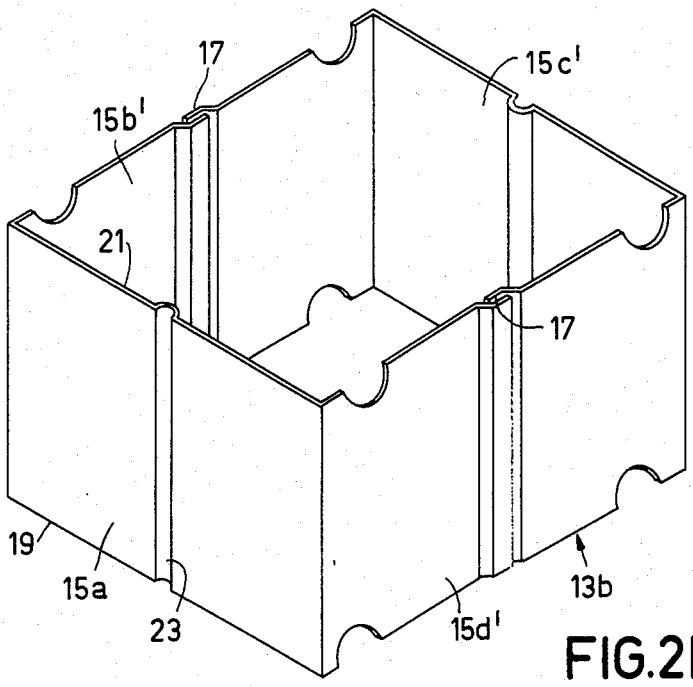

FIG. 2*b* shows a modified embodiment 13*b* of the screening sheath which consists of two halves of the sheet metal strip overlapping each other at the area of the surfaces 15*d* and 15*b'* so that two seams 17 are formed. Which of the screening sheaths will be used depends upon the possibilities of manufacturing and assembly.

Ducts 23 extend in the side surfaces of the sheath between the edges 19 and 21 of the screening sheath. These ducts serve to avoid the switching-on click.

Figure 3:
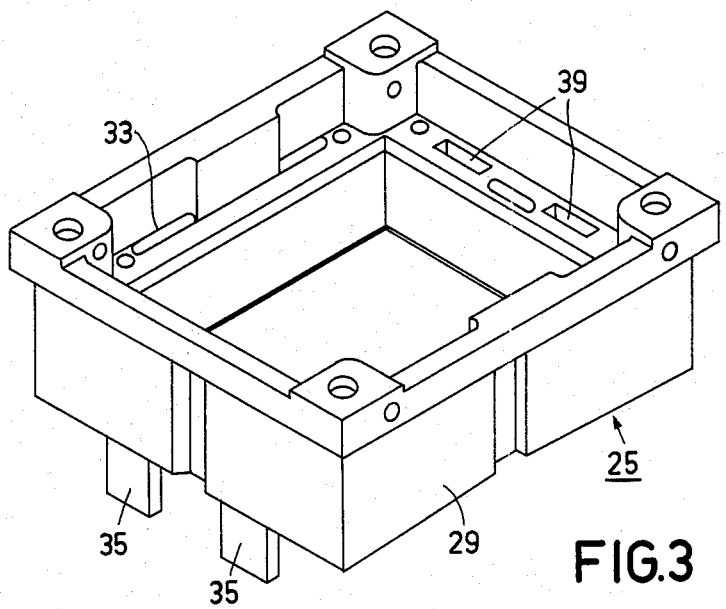
FIGS. 3 and 4 show the top and bottom supporting caps, respectively, for clamping screening sheaths.
Figure 4:
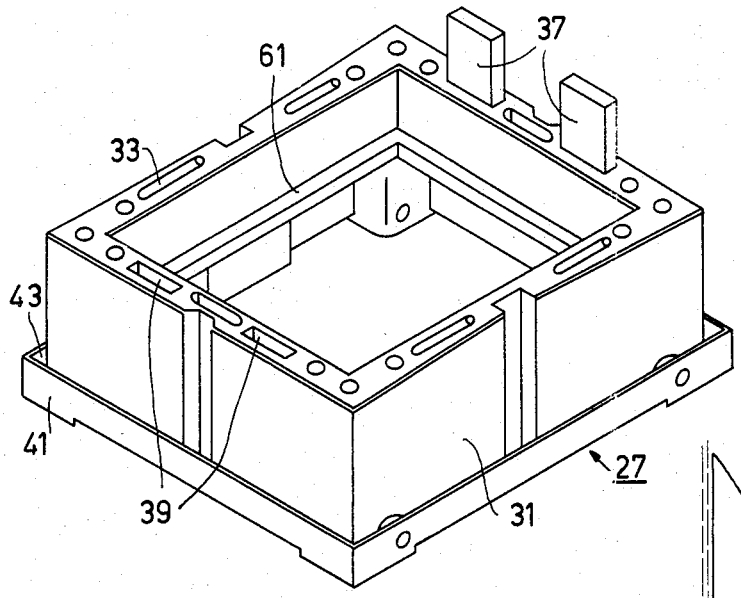

FIGS. 3 and 4 show supporting caps which are placed from the top and from the bottom, respectively, directly on the core of the transformer 3. Both the uppermost supporting cap 25 and the lowermost supporting cap 27 (they may be identical components) comprise collars 29 and 31, respectively, which, after assembly, will surround the outer circumference of the transformer core. The iron of the transformer is then enclosed by the collars 29 and 31. The collars themselves comprise ventilation apertures 33 extending in the direction of mounting. Said ventilation apertures together constitute chimneys which dissipate the heat due to energy losses developed in the transformer.

As shown in FIGS. 3 and 4, the uppermost supporting cap 25 comprises mounting studs 35 and the lowermost supporting cap 27 comprises mounting studs 37. The mounting studs 35 can be inserted into recesses 39 of the lowermost supporting cap 27 and the mounting studs 37 can be inserted into corresponding recesses (not visible) of the uppermost supporting cap 25. The supporting caps 25 and 27 may also be connected to the recesses 39 by cementing, by ultrasonic welding or by thermal welding of the mounting studs 35. By joining the supporting caps 25 and 27, an assembly is obtained which in itself is stable if the supporting caps 25 and 27 are formed to be sufficiently rigid, which in itself is ensured by the collars 29 and 31. A projecting edge 41 extends around the collars 29 and 31 and has a groove 43. The projecting edge 41 with the groove 43 is shown in particular in FIG. 5.

Figure 5:
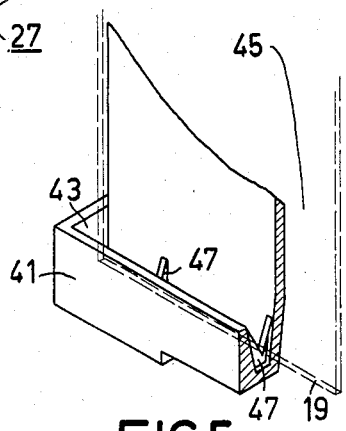
FIG. 5 shows a detail of a groove in a supporting cap for receiving the edges of the screening sheath.

Upon joining the supporting caps 25 and 27, a screening sheath 13*a* or 13*b* is interposed. In FIG. 5 a part 45 of the screening sheath is shown by a dot-and-dash line. The screening sheath 13 penetrates into the groove 43 and is received in lugs 47 extending transversely to the longitudinal direction of the groove. These lugs open towards the open side of the groove 43 in the form of a V. In the course of the assembly the edge 19 of the screening sheath penetrates into the lugs 47. Herewith the edges 19 and 21 of the screening sheath provide a location in the groove 43 which is free from play.

Figure 6:
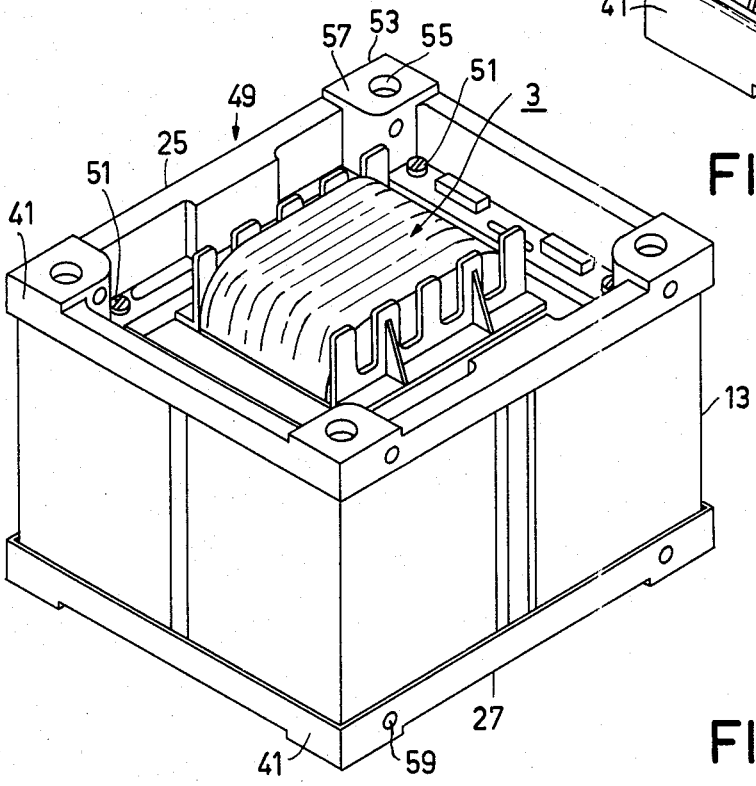
FIG. 6 shows the AC line transformer according to FIG. 1 with assembled screening device.

FIG. 6 shows the screening device 49 assembled around the transformer 3. The uppermost supporting cap 25 and the lowermost supporting cap 27 with their projecting edges 41 are visible. Clamped between the supporting caps 25 and 27 is a screening sheath 13. In this example the supporting caps 25 and 27 are screwed together by means of screws 51. The transformer 3 is fixedly clamped between the supporting caps so that it cannot move inside the screening device. The total construction is so stable that the screening device itself may now be used as a transformer holder. For that purpose, continuous holes 55 are provided at the corners 53 of the screening caps 25 and 27, through which apertures, for example, self-tapping screws can be inserted which can be screwed into a chassis. The transformer with screening device can then bear on a chassis by means of assembly surfaces 57.

Tilted assembly is also possible in which the transformer with the screening device lies on its side and the connection to the chassis is carried out through the apertures 59.

As shown in FIG. 4, the supporting caps 25 and 27 have engagement surfaces 61. These engagement surfaces serve to place the core of the transformer.

What is claimed is:

1. A transformer comprising a ferromagnetic core having windings thereon, a metal screening sheath surrounding the core, first and second supporting caps placed on the transformer from opposite directions and between which the screening sheath is clamped at a distance from the core, the edges of the screening sheath being fixed in grooves in the supporting caps, and wherein the grooves include lugs which extend transversely to the longitudinal direction of the grooves and into which the edges of the screening sheath penetrate thereby to locate the screening sheath in the grooves so as to be free from play.

2. A transformer as claimed in claim 1, characterized in that the lugs open towards the open side of the grooves in the form of a V.

3. A transformer as claimed in claims 1 or 2, characterized in that the supporting caps comprise ventilation apertures above and below a space formed between the core and the screening sheath.

4. A transformer as claimed in claim 1 characterized in that the supporting caps function as an assembly holder for the transformer.

5. A transformer comprising a ferromagnetic core having windings thereon, a metal screening sheath surrounding the core, first and second supporting caps placed on the transformer from opposite directions and between which the screening sheath is clamped at a distance from the core, the edges of the screening sheath being fixed in grooves in the supporting caps, and wherein the screening sheath includes continuous ducts extending between the clamped edges thereof.

6. A transformer as claimed in claim 1 characterized in that the spacing between the core and the screening sheath is approximately 5 to 10 mm.

7. A transformer comprising, a ferromagnetic core having windings thereon, first and second supporting caps each having a rigid collar and mounted about the core from opposite ends so that the collars surround the outer circumference of the core, each of said supporting caps having grooves therein in opposed relationship, and a metal screening sheath surrounding the core and collars and having opposed edges fixed in the grooves of the supporting caps so that the screening sheath is clamped between the supporting caps in spaced relation to the transformer core.

8. A transformer as claimed in claim 7 wherein the supporting caps include ventilation apertures on opposite sides of a space formed between the core and the screening sheath.

9. A transformer as claimed in claim 7 wherein the screening sheath includes a plurality of ducts extending between said opposed edges thereof.

10. A transformer as claimed in claim 7 further comprising a plurality of V-shaped lugs within said grooves and arranged to clamp the edges of the screening sheath.

11. A transformer as claimed in claim 7 wherein each of said collars includes an interior engagement surface having a generally annular shape and which serves to place the transformer core.

12. A transformer as claimed in claim 7 wherein said supporting caps have openings therein of a size and shape comparable to the outer dimensions of the core and windings.

* * * * *